US008820965B2

(12) United States Patent
McNabb et al.

(10) Patent No.: US 8,820,965 B2
(45) Date of Patent: Sep. 2, 2014

(54) FLEXIBLE TROUBLE LIGHT

(71) Applicants: Daniel S. McNabb, Marysville, OH (US); Benjamin H McNabb, Worthington, OH (US)

(72) Inventors: Daniel S. McNabb, Marysville, OH (US); Benjamin H McNabb, Worthington, OH (US)

( * ) Notice: Subject to any disclaimer, the term of this patent is extended or adjusted under 35 U.S.C. 154(b) by 198 days.

(21) Appl. No.: 13/658,190

(22) Filed: Oct. 23, 2012

(65) Prior Publication Data

US 2013/0107514 A1 May 2, 2013

Related U.S. Application Data

(60) Provisional application No. 61/550,786, filed on Oct. 24, 2011.

(51) Int. Cl.

| | |
|---|---|
| ***F21V 21/00*** | (2006.01) |
| ***F21V 9/00*** | (2006.01) |
| ***F21V 5/04*** | (2006.01) |
| ***F21S 4/00*** | (2006.01) |
| *F21S 8/00* | (2006.01) |
| *F21S 6/00* | (2006.01) |
| *F21Y 101/02* | (2006.01) |
| *F21V 21/03* | (2006.01) |
| *F21S 9/02* | (2006.01) |
| *F21V 23/04* | (2006.01) |
| *F21V 21/06* | (2006.01) |
| *F21V 17/00* | (2006.01) |

(52) U.S. Cl.

CPC . *F21V 21/00* (2013.01); *F21V 9/00* (2013.01); *F21V 5/04* (2013.01); *F21S 8/033* (2013.01); *F21S 6/005* (2013.01); *F21Y 2101/02* (2013.01); *F21S 6/002* (2013.01); *F21V 21/03* (2013.01); *F21S 4/005* (2013.01); *F21S 9/02* (2013.01); *F21V 23/04* (2013.01); *F21V 21/06* (2013.01); *F21V 17/007* (2013.01)

USPC ..... 362/249.02; 362/249.04; 362/249.06

(58) Field of Classification Search

USPC ..... 362/249.02, 249.04, 249.06, 217.1, 555

See application file for complete search history.

(56) References Cited

U.S. PATENT DOCUMENTS

| | | | | |
|---|---|---|---|---|
| 5,957,564 | A * | 9/1999 | Bruce et al. | 362/84 |
| 6,371,637 | B1 * | 4/2002 | Atchinson et al. | 362/555 |
| 7,210,818 | B2 | 5/2007 | Luk | |
| 7,244,045 | B2 * | 7/2007 | Schrimmer et al. | 362/555 |

* cited by examiner

*Primary Examiner* — Vip Patel

(74) *Attorney, Agent, or Firm* — Porter Wright Morris & Arthur, LLP

(57) ABSTRACT

A lighting device comprising a sealed transparent flexible outer tube having a handle at a first end. The handle includes a power source. Inside the tube is a flexible wire extending from and attached to the handle. The wire extending the length of the outer tube. Also inside the tube are multiple small lengths of inflexible interior tubing running at least a partial length of the flexible outer tube. Each interior tubing having at least one light emitting diode and at least one resistor inside. The resistors and diodes are connected electronically to a circuit board and the power source.

15 Claims, 6 Drawing Sheets

FLEXIBLE TROUBLE LIGHT

CROSS-REFERENCES TO RELATED APPLICATIONS

This patent application claims the benefit of provisional patent application Ser. No. 61/550,786, filed Oct. 24, 2011, the complete subject matter of which is hereby incorporated herein by reference in its entirety.

FIELD OF THE INVENTION

The present invention relates to a flexible light using light emitting diodes (LEDs).

BACKGROUND AND SUMMARY

A highly shapeable lighting device includes sturdy casings for light emitting diodes, flexible wires between the eases of diodes, a shapeable spine, a rechargeable battery pack, and a compact handle holding the batteries and charging port. The shapeable spine allows the device to be straightened for use in a deep dark area, and it can be tightly balled up or folded for easy storage. The flexible outer tube makes it easy to wrap an end around a nearby object, grasping it tightly, casting light all around it. The lights are bright enough to provide good lighting for projects where space to hang or position other trouble lights or flashlights is difficult. The material holding the LEDs also holds the two wires that come out of each end of the LED plug. The device may or may not be rechargeable.

In an embodiment, the lighting device comprises a sealed transparent flexible outer tube having a handle at a first end, the handle having a power source; a flexible wire, the wire plastically deformable and shapeable, the flexible wire inside the flexible outer tube and extending from and attached to the handle, the wire extending the length of the outer tube to an opposite end of the flexible outer tube; multiple small lengths of inflexible interior tubing, the interior tubing lengths having at least one light emitting diode (LED) and at least one resistor inside an interior of the interior tube, each resistor connected electronically in series to a corresponding LED, each resistor/LED combination connected via a circuit board electronically in parallel to each other; each resistor/LED/circuit board in each length connected to each other in parallel and to the power source, the multiple small lengths of interior tubing inside the outer tube and running at least a partial length of the flexible outer tube. In an embodiment, more than one LED is wired to a single resistor. In an embodiment, a dimmer control is interconnected electronically to the power source and the diodes. In an embodiment, a voltage booster and a charging circuit are interconnected electronically to the power source and the diodes. In an embodiment, each interior tubing length comprises a swivel joint connecting that interior tubing length to the next interior tubing length.

In an embodiment, the diodes have a 120 degree viewing angle and are arranged such that the light emits through the tubes at a 120 degree arc.

In an embodiment, the outer tube is made of a highly flexible vinyl material, the length of the first flexible tubing is about 25-26", the outer tube having a wall thickness of about 1/16", an inner diameter of about 1/2" and an outer diameter of about 5/8"; the interior tubing made of a hard plastic, having a length of about 1" and having an inner diameter of about 1/4" and an outer diameter of about 3/8".

In an embodiment, the lighting device comprises an additional diode having a smaller viewing angle located at a second end of the first flexible tube. The additional diode viewing angle is positioned in a different direction than the multiple diodes.

In an embodiment, the handle comprises a connecting apparatus that releasably engages the outer flexible tube. In an embodiment, the interior tubing comprises a cover that extends the length of the tubing, the cover covering a portion of a diameter of the tubing. the interior tubing may be translucent or be coated or infused with a tint or color or the circuit board comprises a switch that changes the color of the light emitted by the diode.

In an embodiment, a lens that magnifies and directs light emitting from the diode is adjacent to each diode.

In an embodiment, the interior tubing lengths are spaced about 2" apart on center.

Other devices that are similar in their composition and could be considered prior art are either the led trouble light stick which is a solid stick, or a strand of LEDs on a flexible circuit board. There is also a flat, somewhat large flexible square with LEDs mounted to the flexible substrate. These lights are restrictive in their usefulness. The flexible mat can be shaped, but is too large to fit into crevasses. The light tube fits into crevasses, but its lack of flexibility makes it difficult to position for hands-free use.

Unfortunately, the limpness and lack of formability of a normal rope light made it less than friendly to use. Also, rope lights produce very little light outside of the tube they are extruded inside of.

Previous art describes flexible LEDs in a continuous strand. This method works great for gently wrapping around banisters, but will not stand up to the stress created by repeatedly bending and shaping around objects.

What is needed is a trouble light that can more easily and dynamically be positioned to provide appropriate lighting for everyday tasks. No other product or patent combines flexibility, recharge ability, a series of plugs with LEDs, and holding power like this device.

DETAILED DESCRIPTION

Figure 1:
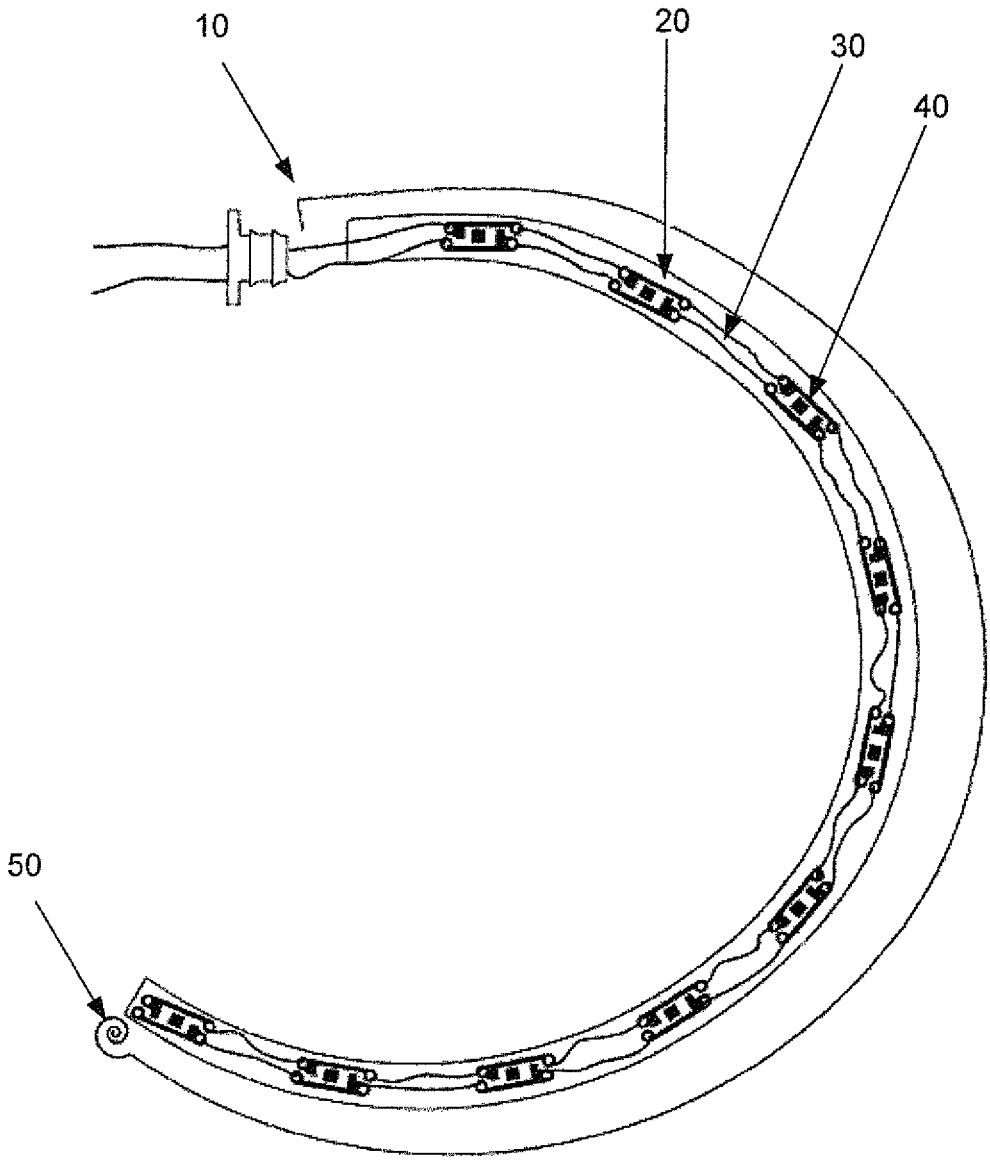
FIG. 1 is a side view of an embodiment of the invention.

This device is so flexible it can be looped several times around a single pipe or tube. It can be wrapped around its own handle, creating a very small profile, easy to store in a toolbox. The small size of the tube allows it to easily be placed inside of areas no other flashlight will fit. This device provides better portable illumination in tight areas than any other current device. The smooth outside of the tube allows it to easily be inserted and withdrawn from tight areas like engine compartments or inside of furnaces.

The round aluminum wire used to provide flexibility and holding power is able to move 360 degrees, any direction from the handle.

There is optionally an additional LED at the tip to provide extremely easy to direct directional lighting.

There is slack in the sets of wires between the LED plugs so using the device will not pull on the wire.

The LEDs used are Cree, surface mount, 120 degree viewing angle. This allows the light to be cast widely, but not all the way around the device. The size of the LED is small enough to fit inside a ¼ I.D. vinyl tube along with the wires needed for the circuit. The inside tube is used to create LED/resistor/hot glue "plugs," and is made up often small pieces of tube, each one measuring about an inch in length. The second tube (interior tube) is not flexible, because it protects the circuitry parts.

The aluminum wire is secured into the same barbed fitting the tube is attached to. This keeps it attached to the handle, and will not separate from the handle.

The outer tubing is made of a highly flexible vinyl material with a 1/16" wall thickness, ½" ID and ⅝" OD.

The inner tubing pieces used to encase the LEDs is ¼" I.D., ⅜" O.D.

The bendy wire is aluminum approx=0.07" wire, uncoated.

Resistors are connected in series to the LED, resistor and LED combinations are then wired in parallel.

The battery life from three AAA batteries can be over 4000 mah. That is enough power to support the light for a minimum of 5 hours without using resistors.

The plugs are encased with clear hot glue inside of a thin walled tube. Two wires come out of each end of the plug, each plug connected by the wires. Only two 18 awg wires are used. It uses tight fitting, strong tubes as the plug around the LED, and just a dab of glue to hold them in place. The fit is tight enough to hold the wires and keep the LED, and the wires they are soldered to, from moving.

The barbed fitting used to attach the tube to the handle is a ½" barb.

The aluminum wire is looped at the end opposite the handle to keep it from poking through the tube.

The power switch for the light is located so that it will not be accidentally switched while positioning the device.

Extra measures are taken to secure the circuit board and barbed fitting to the handle. Without a locking washer or very low tolerance fit, the ground could come loose from the body of the handle, wherein the ground is attached to the switch and battery.

The aluminum wire is looped at the end of the device furthest from the handle, and encased in glue or plastic. This forms a cap for the tube so that debris cannot enter the tube. This style cap allows the end of the tube furthest from the handle remains the same diameter as the rest of the tube.

The aluminum wire inside the tube used to position the device is large enough to hold the light into position when wrapped, but as small as possible to avoid damaging the light plugs and the tube. A small diameter wire makes the device easy for anyone to bend into position. Ideally, there is a harmonious balance between flexibility and rigidity.

A barbed fitting is used to secure the tube to the handle, and a small hole is molded into the handle to provide a place for the end of the bendy wire to be secured. The wire is bent and forced into the hole.

A LED with a smaller viewing angle is used at the tip opposite the handle for more directional light.

The LED plugs are spaced about 2" apart on center, and about 2" from the barbed fitting by the handle to allow for the most flexibility at the handle joint.

The overall length of the device is about 25-26". The length of the first tube is about 21". The outside diameter of the handle is about 1.08"

The LEDs are wired in parallel, and an appropriate battery is used to avoid the use of resistors.

Glow in the dark plastic is optionally incorporated into the handle to make the device easy to locate.

One embodiment uses a rubber plug for the charging port, o-rings around the battery door, and the end of the tube sealed to make the device submersible. In one embodiment, the handle is made of aluminum, using the body of a cheap aluminum flashlight. This handle holds a battery holder, which holds three AAA size batteries. A firm glue and tight fitting barbed fitting are enough to hold the tube end of the light onto the cheap aluminum handle. Another embodiment uses a barbed fitting at the tip of the light instead of hot glue to seal the end opposite the handle. In another embodiment, each of the LEDs in the circuit is wired in parallel. This allows several LEDs to be powered by a low voltage power supply, specifically small batteries. Another embodiment uses as small as possible circuit boards inside the "plugs" instead of only a bulb and/or resistor. Another embodiment is a floor lamp, table lamp, or wall fixture, which includes a larger base, big enough to keep the tube from falling over. This embodiment uses multiple tubes and a single base, or a single tube and multiple bases, or a single tube and single base, or multiple tubes and multiple bases. It is powered by 120 v standard plug outlet. In another embodiment, the overall size of the device could be as tall as 10 ft, when used as a lamp or a semi-permanently installed task light. Another embodiment is an extremely long version that could be any length, with any number of LEDs. In another embodiment, it is as small as the smallest available LED's and batteries will allow. The size of the LEDs and batteries are complimentary to one another. For example, if 3.2 v max LEDs are used, 2 AA or 2 AAA batteries provide sufficient voltage for their operation. Using only 2 AA or AAA batteries with 3.8 v LEDs does not utilize the full potential luminous output of the LED. Another embodiment uses any size tubing, different size inside and outside dimensions of tube can make the device usable in more applications. Also, different wall thicknesses of tubing can be used to create a different feel. Using UV bulbs in manufacturing creates a highly adaptable material curing device. Another embodiment joins the tip of the device with the handle, creating a doughnut shape. Another embodiment uses a small device permanently installed on the handle or the tip of the light to allow the two ends to be joined together, creating the doughnut shape. Another embodiment uses a sleeve to cover part of the device if some part shined in the user's eyes during use. This is cloth or plastic piece, entirely black, or half black and half clear.

The type and capacity of the battery can greatly impact the amount of time the device will stay its brightest. Because the circuit will operate for longer periods of time more consistently with resistors, one embodiment does not have resistors. Resistors are used in series with ground on each LED in a parallel circuit. This requires the use of a specialized resistor or resistor housing, a circuit board, or a third wire with resistors made into plugs similar to the LED plugs. In another embodiment, through-hole style LEDs are used similarly, their leads connected to each other inside a "plug" then wired in parallel, with or without resistors. Another embodiment uses different color or shapes of handles. Another embodiment is an extra loop or wrist wrap at the handle to allow the user to affix the handle to their hand without gripping the light. Another embodiment uses a very small diameter tube.

As LED technology develops smaller, brighter LEDs, smaller versions of this device are possible to manufacture. Since there is no way to know how small the LEDs can get, there is no way to know how small this device will be able to be in the future, however, it will become more useful to industries specializing in small materials or processes as the device gets smaller.

Another embodiment uses any style or color of light bulb. Another embodiment uses a translucent tube instead of transparent. Another embodiment is a deep-water submersible version. The difference would be quality, tested seals. The tube is filled with something other than air so that it does not expand at deep water depths. Another embodiment uses a tint, colored, smoked, or a hazed tube. It is included in the material the tube is constructed from, it may be applied after extrusion, and it may take the form of an outer most jacket for the device. Another embodiment uses Nitinol wire instead of aluminum for the bendy wire. Nitinol is bent to shape, heat treated, then attached to the handle and a power supply that provides enough voltage to heat the Nitinol to return it to its originally formed shape. One embodiment has the entire circuit inside of a solid tube. It is extruded along with the circuit. There are any number of LED's spaced any distance apart. The LED's are wired in sets of two or three per resistor. One embodiment uses an LED circuit wired in series using a voltage booster to up the voltage from the batteries to enough to power the circuit. Using 10 LEDs with forward voltage rating of 3.8 requires increasing the voltage to over 38 volts, and the use of one resistor. Another embodiment uses sections of plastic housings for the LEDs, each connected with a swivel or flexible joint giving it the same abilities as the version in the tube. One version uses a dimmer control. LED's are dimmed by sending pulses of electricity to quickly turn them on and off. Because they are able to change so quickly from on to off, they can appear to be dim. This is done by regulating the current to the circuit. Another embodiment uses a circuit board to control color changing LEDs. A readily available selector switch changes colors allowing the device to produce any RGB color. Another embodiment does not use plugs, but instead the entire tube is solid, with the bendy wire and circuitry extruded directly into a tube shape. This embodiment requires a different method for securing the tube to the handle. Instead of a barbed fitting, it is a reversed barb or simply glued, stapled, riveted or melted. Another embodiment uses the aluminum wire for the ground in the electrical circuit. Another embodiment uses LEDs custom made to be able to be stapled onto wires. If the leads off the LEDs are made sharp and strong, they can pierce the insulation on a wire, then curl underneath to secure the connection. One embodiment uses two pieces of plastic fitted together to encapsulate the LEDs and form the plugs that protect the bulbs. There are two ways to do this, either two stacked pieces or two side-by-side pieces. Both pieces could be clear or semi-clear, the piece covering the bulb incorporates a lens to magnify or direct the light emitting from the device.

In any embodiment the battery is an appropriate size for the number and type of LEDs and lighting circuit. One embodiment uses a any battery voltage or wall plug-in 120 v. One embodiment uses UV coating is used on the tube to keep the LEDs from deteriorating in the sunlight.

It's the perfect trouble light for finding bolts in engine compartments, changing brakes, finding socks under your bed, or keeping the kids entertained for a while. Because it can be shaped into anything and hold its position, its uses are endless. I like to cram it up under the dash of my car so I can see my carpet when I'm vacuuming it. It doesn't shine in my eyes because it's tucked under the dash. I straighten it and make a 90 degree bend about 3 inches from each end so it fits, and then I push it up under the dash. The bend n stay wire makes the device one big spring, so it stays tucked up where I can't see it, but I can see the light. The device can be positioned so the light is directed toward the work area and not the eyes of the worker. I can't wait to change my brakes next time and not have to fumble around for fifteen minutes with a flashlight to find the two bolts to take off my calipers. I'll just wrap my light around the spring and shock. The light is out of my way but still shining right where I need it.

The need for this device came from trying to position and reposition different trouble lights and flashlights while working underneath the dashboards of cars and trucks. There was simply not a product you could set in place once, finish your job, and then easily remove it from the vehicle. From this, the thought of making a rope light with a battery pack seemed like the solution.

As used herein, "approximately" means within plus or minus 25% of the term it qualifies. The term "about" means between ½ and 2 times the term it qualifies. The compositions of the present invention can comprise, consist of, or consist essentially of the essential elements and limitations of the invention described herein, as well as any additional or optional ingredients, components, or limitations described herein or otherwise useful in compositions and methods of the general type as described herein.

Numerical ranges as used herein are intended to include every number and subset of numbers contained within that range, whether specifically disclosed or not. Further, these numerical ranges should be construed as providing support for a claim directed to any number or subset of numbers in that range or to be limited to the exact conversion to a different measuring system, such, but not limited to, as between inches and millimeters.

All references to singular characteristics or limitations of the present invention shall include the corresponding plural characteristic or limitation, and vice versa, unless otherwise specified or clearly implied to the contrary by the context in which the reference is made.

All combinations as used herein can be assembled in any order, unless otherwise specified or clearly implied to the contrary by the context in which the referenced combination is made. Terms such as "top," "bottom," "right," "left," "above", "under", "side" "front" and "back" and the like, are words of convenience and are not to be construed as limiting.

Reference will now be made in detail to the exemplary embodiments of the invention, examples of which are illustrated in the accompanying drawings. In accordance with an embodiment of the present invention as depicted in FIG. 1, the end of the memory wire 10 close to the barb is kinked at an about 90 degree angle and fitted into a small hole drilled inside the plastic barb. The wire is an aluminum "bend n stay" wire that goes inside the tube (not shown). When you put an unprotected circuit board inside a tube with an aluminum wire, and apply enough force to the tube to wrap it tightly or bend it 180 degrees, the board and components will be destroyed. Similar products in design to this are used for decoration, to be wrapped around banisters and such, and to be left in place. Any protection they provide against damage is minimal, and not enough to allow such a device to be used as a tool, aggressively wrapped and unwrapped multiple times a day. Leaving the circuit boards 20 *a-n* separate from the memory wire, allows them to move freely from one another, extending the life of the memory wire, and reducing the stress created when contorted. Extra slack is left in the wires 30*a-n* between each circuit board to eliminate the stress caused to them by contorting the light 40. A small loop 50 at the end of the memory wire creates part of the cap (not shown) for the device. When a glue or epoxy is filled around the loop, it holds together the loop, the circuit board, and the end of the tube.

Figure 2:
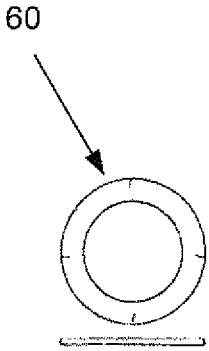
FIG. 2 is a sectional view of a tube.

As shown in FIG. 2, a firm glue and tight fitting barbed fitting 60 are enough to hold the tube end of the light onto the handle. The fitting is a thin, flat locking washer with four cuts at 12, 3, 6, & 9 o'clock. One embodiment uses this to hold the circuit board firmly in place, so ground stays connected to the body of the handle.

Figure 3:
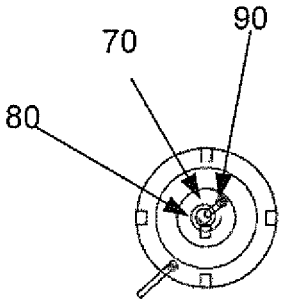
FIG. 3 is a sectional view of a tube containing an LED and wiring.
Figure 4:
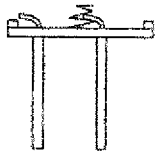
FIG. 4 is a side view showing the wiring of the circuit board.

FIG. 3 depicts a circuit board 70 with a spring 80 to connect the positive end of the battery pack 90. It also has holes where the positive and negative wires from the light strand are soldered onto the board in a through-hole method. This circuit board could also hold the charging circuit and/or the voltage boosting circuit. In another embodiment, only a positive contact is used and the negative wire is secured directly to the handle providing ground. FIG. 4 shows the wires coming through the circuit board.

Figure 5:
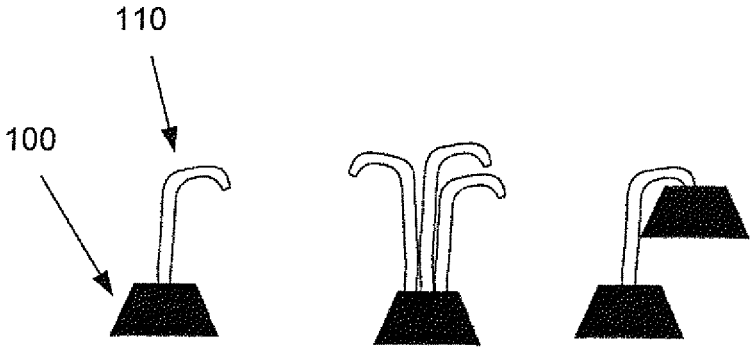
FIG. 5 depicts alternate arrangements of the invention used with a base.

FIG. 5 depicts an embodiment as a floor lamp, table lamp, or wall fixture, which includes a larger base 100, big enough to keep the tube 110 from falling over. This embodiment optionally use multiple tubes and a single base, or a single tube and multiple bases, or a single tube and single base, or multiple tubes and multiple bases. It could be powered by 120 v standard plug outlet.

Figure 6:
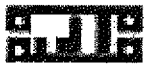
FIG. 6 is a diagram of the design of a circuit board of an embodiment.
Figure 7:
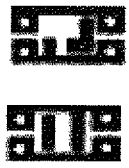
FIG. 7 is a diagram of the design of a double-sided circuit of an embodiment.

FIG. 6 depicts the design of the circuit board, allowing four wires to be attached to allow several lights to be wired in parallel. FIG. 7 depicts a double-sided circuit used to reduce the size of the footprint of the led plug.

Figure 8:
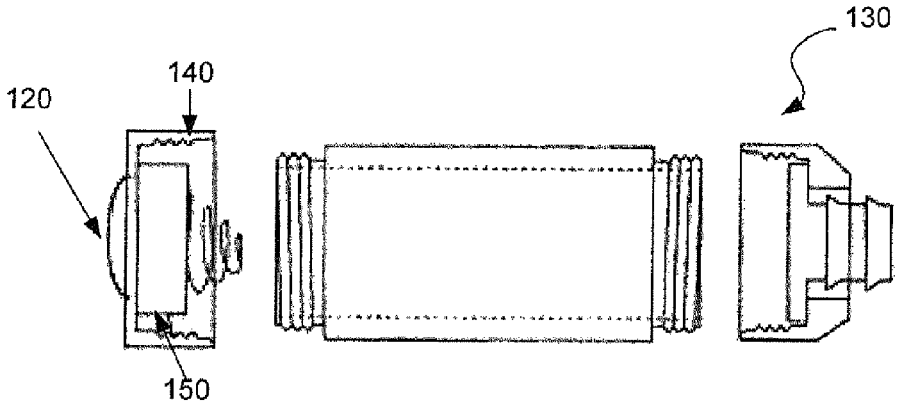
FIG. 8 depicts a side see-through view of a disassembled handle of an embodiment.

FIG. 8 depicts a disassembled handle 130. A switch 120 located in the bottom of a handle to avoid accidental operation. Contact from the switch is made at the battery spring and the body of the light, switching the ground. A soft, water tight button cover (not shown) is used in the bottom cap. The handle may be different sizes depending on the size of the tool. The handle is round, flat, or polygon shaped. In an embodiment, the handle is constructed of plastic and the barbed fitting is molded into the handle. A charging circuit 140 is in the bottom of the handle as well, along with a voltage booster 150 to allow for rechargeable batteries and the LEDs to be wired in series.

Figure 9:
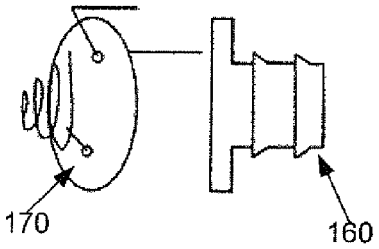
FIG. 9 is a side view of a barbed fitting with a disc circuit board.
Figure 12:
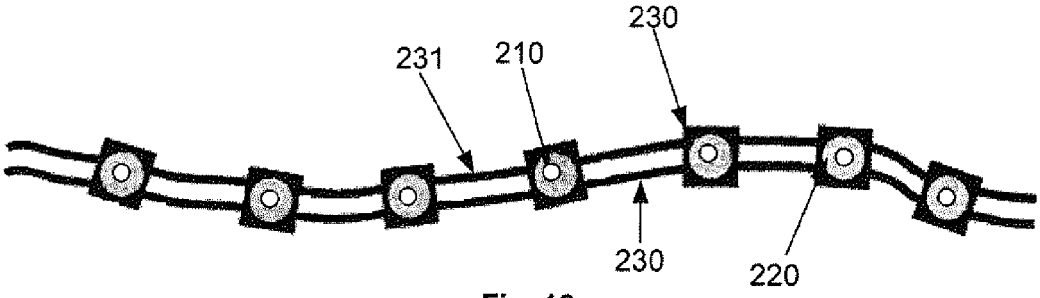
FIG. 12 is a top view of a string of LEDs of an embodiment.

FIG. 9 depicts the barbed fitting 160 with a disc 170 that is a circuit board where the positive and negative terminals are attached from the strip of LEDs (see FIG. 12). The barbed fitting could also be glued in place instead of having a specially machined top for the handle. A normal flashlight handle may be used.

Figure 10:
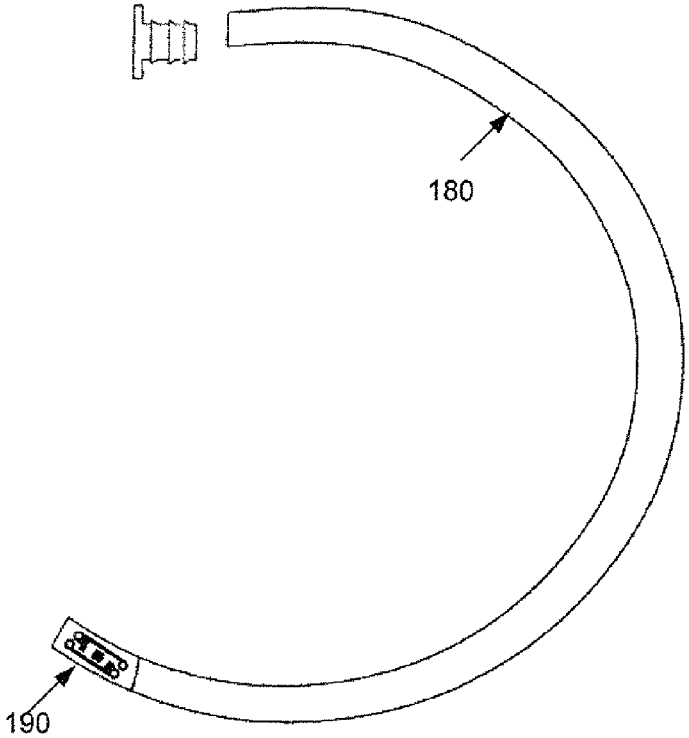
FIG. 10 is a depicts an side exploded view of the barbed fitting in relation to the tube.
Figure 11:
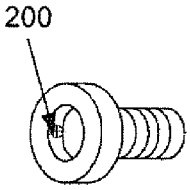
FIG. 11 is a perspective view of a barbed fitting showing the hole to contain the bendy wire.

FIG. 10 depicts an exploded view of the barbed fitting in relation to the tube 180. The barbed fitting that is secured in the handle of the device is fitted to the tube to create a water-tight seal. The tube can be extruded with the lights inside, and/or with the bendy wire inside. This is done within the walls of the tube, or within the inside of the tube, making the tube somewhat solid. The end 190 of the tube is filled around the last LED circuit board to seal the other end of the device making it water resistant, and enclosing the circuit boards and memory wire. In an embodiment, the tube itself is sealed shut to itself, folded, stapled, glued or melted. A plug (not shown) made of plastic or other suitable material is optionally used to seal the end as well. Another embodiment uses a barbed fitting with a swivel, allowing the tube to swivel opposite the handle. The swivel joint is located under the barbs and on top of the flange. In another embodiment, a barbed fitting is used to secure the tube to the handle, and a small hole 200 is drilled or molded into the fitting to provide a place for the end of the bendy wire to be secured. The wire is bent and forced into the hole (see FIG. 11).

Figure 13:
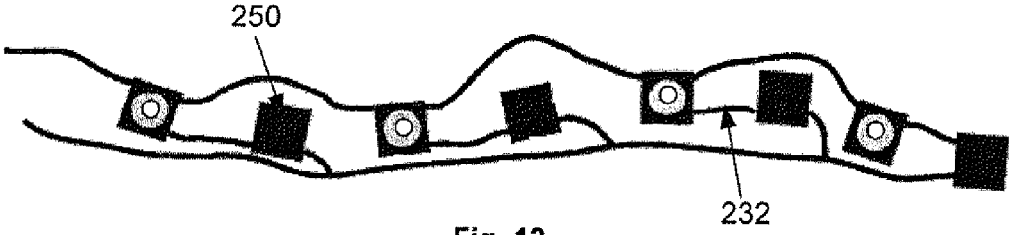
FIG. 13 is a top view an alternately wired string of LEDs.
Figure 14:
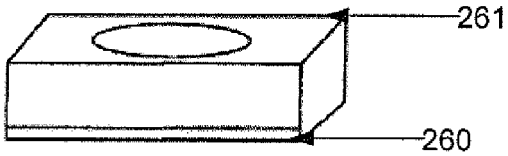
FIG. 14 is a perspective view of the small plastic container containing the resistor of an embodiment.

FIG. 12 depicts a string of LEDs. Each LED 210 *a-n* is encapsulated, such as by using two pieces of plastic 220 *a-n* fitted together, to protect the LED from the stress created by use of the device from the outer tube and the aluminum wire squeezing the LED circuit board. Each encapsulated LED is connected by wires 230 *a-n*, 231*a-n* (positive and negative) and to each circuit board 240 *a-n*. In an embodiment, the wires are soldered directly to the LED bulb. One wire for positive, another for negative, to achieve a series circuit. One embodiment uses a through-hole style resistor 250 *a-n* laid on the negative contact of the LED, the other end attached to the negative wire, allowing the use of only two wires. Another embodiment (depicted in FIG. 13), uses a third wire 232 *a-n* and resistor plugs 250 *a-n* as well as led plugs. In this version, the resistors lie in between each LED plug. The LED plug is in close proximity to the supporting resistor plug. This keeps the amount of wire used to a minimum, and saves space inside the tube. In an embodiment depicted in FIG. 14, the resistor is potted into a small plastic container. The resister is wired in series to improve battery life. Contacts 260, 261 are on the top and bottom of the resistor block.

Figure 15:
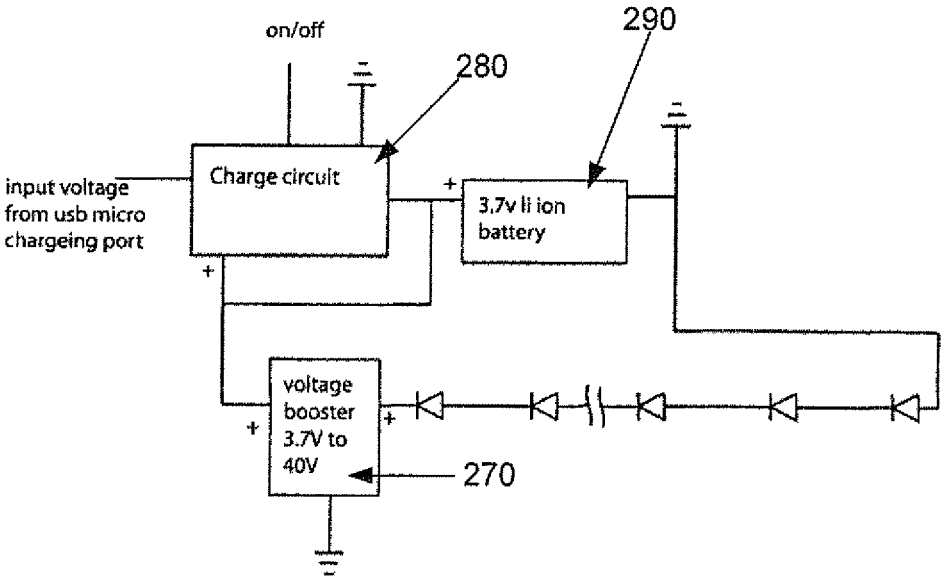
FIG. 15 is a schematic diagram of the wiring of an embodiment of the device.

FIG. 15 is a diagram of the wiring of an embodiment of the device. In an embodiment, the device comprises a voltage booster 270 and a charging circuit 280. The voltage booster allows the circuit to operate at low current, but higher voltage than batteries alone could provide. 3.7 v is a standard cell size for Lithium Ion batteries. They are small and can be charged thousands of times. These components add longevity and usefulness to the device. in an embodiment. the battery 290, charging circuit, and voltage booster are located in the handle of the device. In an embodiment, the device uses replaceable batteries without a voltage booster.

Figure 16:
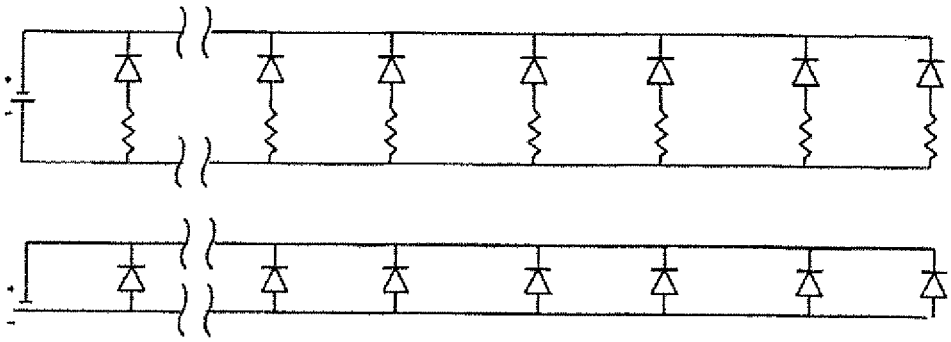
FIG. 16 depicts two alternate schematic diagrams of wiring of resistors (in series and in parallel).

FIG. 16 depicts diagrams of various wiring of resistors wired in series and with each parallel resistor.

Figure 17:
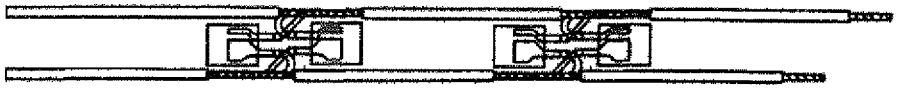
FIG. 17 depicts a top view of an embodiment using through-hole style bulbs that fit inside a plug.

FIG. 17 depicts through-hole style bulbs used in low profile to fit inside a plug.

Figure 18:
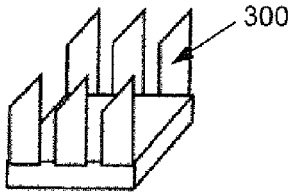
FIG. 18 is a perspective view of an embodiment depicting leads coming off the LED.

FIG. 18 depicts an embodiment where the leads 300 *a-n* coming off the LED are lengthened and made into a staple shape, allowing them to be stapled into the wire. When carefully pressed into a die similar to a normal stapler, the ends will curl under creating a tight connection with the wire, as a normal staple does when stapled through paper.

Figure 19:
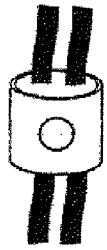
FIG. 19 is a perspective view of an embodiment having the LED encased in a clear plug with wiring.

FIG. 19 is a detailed depiction of an LED encased in a clear plug.

Figure 20:
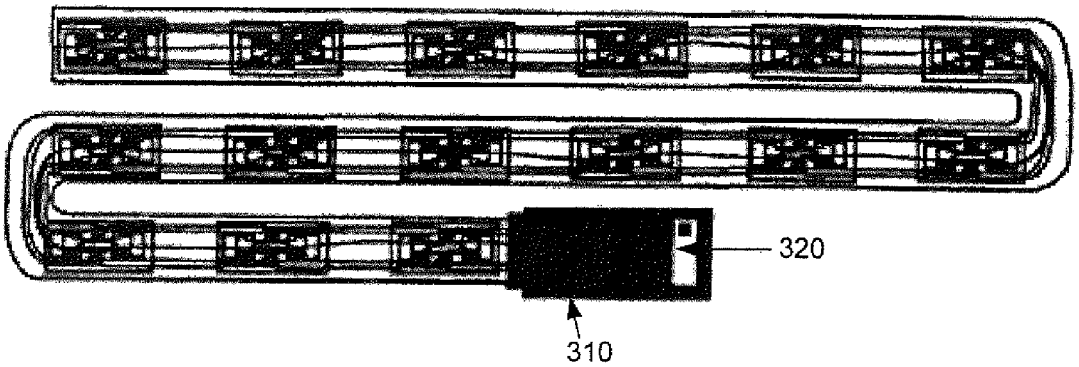
FIG. 20 depicts an assembled embodiment of the invention.

FIG. 20 depicts an alternate handle 310 and through-hole style bulbs. In an embodiment, the device comprises a selectable dimmer switch 320.

The foregoing descriptions of specific embodiments and examples of the present invention have been presented for purposes of illustration and description. They are not intended to be exhaustive or to limit the invention to the precise forms disclosed, and obviously many modifications and variations are possible in light of the above teachings. It will be understood that the invention is intended to cover alternatives, modifications and equivalents. The embodiments were chosen and described in order to best explain the principles of the invention and its practical application, to thereby enable others skilled in the art to best utilize the invention and various embodiments with various modifications as are suited to the particular use contemplated. It is therefore to be understood that within the scope of the appended claims, the invention may be practiced otherwise than as specifically described herein.

We claim:

1. A lighting device comprising:

a sealed transparent flexible outer tube having a handle at a first end, the handle having a power source;

a flexible wire, the wire plastically deformable and shapeable, the flexible wire inside the flexible outer tube and extending from and attached to the handle, the wire extending the length of the outer tube to an opposite end of the flexible outer tube;

multiple small lengths of inflexible interior tubing, the interior tubing lengths having at least one light emitting diode (LED) and at least one resistor inside an interior of the interior tube, each resistor connected electronically in series to a corresponding LED, each resistor/LED combination connected via a circuit board electronically in parallel to each other; each resistor/LED/circuit board in each length connected to each other in parallel and to the power source, the multiple small lengths of interior tubing inside the outer tube and running at least a partial length of the flexible outer tube.

2. The lighting device of claim 1 wherein the diodes have a 120 degree viewing angle and are arranged such that the light emits through the tubes at a 120 degree arc.

3. The lighting device of claim 1 wherein the outer tube is made of a highly flexible vinyl material, the length of the first flexible tubing is about 25-26", the outer tube having a wall thickness of about 1/16", an inner diameter of about 1/2" and an outer diameter of about 5/8"; the interior tubing made of a hard plastic, having a length of about 1" and having an inner diameter of about 1/4" and an outer diameter of about 3/8".

4. The lighting device of claim 2 further comprising an additional diode having a smaller viewing angle located at a second end of the first flexible tube; said additional diode viewing angle positioned in a different direction than the multiple diodes.

5. The lighting device of claim 1 wherein the handle comprises a connecting apparatus that releasably engages the outer flexible tube.

6. The lighting device of claim 1 wherein the interior tubing comprises a cover that extends the length of the tubing, the cover covering a portion of a diameter of the tubing.

7. The lighting device of claim 1 wherein the interior tubing is translucent.

8. The lighting device of claim 1 wherein at least one of the outer tube and interior tubing comprises a tint or color.

9. The lighting device of claim 1 further comprising a dimmer control interconnected electronically to the power source and the diodes.

10. The lighting device of claim 1 wherein the circuit board comprises a switch that changes the color of the light emitted by the diode.

11. The lighting device of claim 1 further comprising a lens adjacent to the diode, the lens magnifying and directing light emitting from the diode.

12. The lighting device of claim 1 wherein the interior tubing lengths are spaced about 2" apart on center.

13. The lighting device of claim 1 wherein more than one LED is wired to one resistor.

14. The lighting device of claim 1 further comprising a voltage booster and a charging circuit interconnected electronically to the power source and the diodes.

15. The lighting device of claim 1 wherein each interior tubing length comprises a swivel joint connecting that interior tubing length to the next interior tubing length.

* * * * *